US005885153A

United States Patent [19]

Bateman

[11] Patent Number: 5,885,153

[45] Date of Patent: Mar. 23, 1999

[54] EAVE VENTILATION SYSTEM

[76] Inventor: William Kevin Bateman, 1723 Wagon Gap Trail, Houston, Tex. 77090

[21] Appl. No.: 929,573

[22] Filed: Sep. 15, 1997

[51] Int. Cl.[6] ..... F24F 7/02

[52] U.S. Cl. ..... 454/260; 52/94; 454/275

[58] Field of Search ..... 454/260, 275, 454/277, 280; 52/94, 95

[56] References Cited

U.S. PATENT DOCUMENTS

| | | | |
|---|---|---|---|
| 3,051,071 | 8/1962 | Leigh | 98/37 |
| 4,607,566 | 8/1986 | Bottomore | 98/37 |
| 4,995,308 | 2/1991 | Waggoner | 98/37 |
| 5,328,406 | 7/1994 | Morris, Jr. et al. | 454/260 |
| 5,577,354 | 11/1996 | Van Doren | 52/94 |

FOREIGN PATENT DOCUMENTS

| | | | |
|---|---|---|---|
| 1073258 | 3/1980 | Canada | 98/31 |

*Primary Examiner*—Harold Joyce
*Assistant Examiner*—Derek S. Boles
*Attorney, Agent, or Firm*—Michael B. Jolly

[57] ABSTRACT

A continuous roof drip edge ventilation system providing a system for adapting the continuous roof drip edge vent to corners. Corner pieces are provided which are quickly installed on a roof inside or outside corner which facilitates installation of the continuous venting material around corners. Also a system for providing a short nonlouvered end section of the continuous venting material and angled cuts on the venting material adapting the venting material for corners without the need for the separate corner pieces.

9 Claims, 4 Drawing Sheets

EAVE VENTILATION SYSTEM

BACKGROUND OF THE INVENTION

This invention relates to roof ventilation systems which is installed on a roof edge and supplies continuous ventilation to an attic space in the building. More particularly this invention is directed to a system for providing a continuous vent and an easy to install vent system which is adaptable to both inside and outside corners of a roof intended to be vented. This invention is also an improvement of the eave vent as described in patent application Ser. No. 08/634,021 which claims and describes a one piece continuous roof edge vent. A continuous eave vent which is installed on the edge of a inclined roof structure is intended to supply continuous venting along the roof edge which location serves to prevent ice damning on the roof, dead air spaces within the vented attic space and reduction in humidity levels within the vented attic space. Prior to this invention in order for a continuous vent to be adapted to an inside and/or outside corner of a roof to be vented the installer was required to make modifications to the vent material to adapt it for the particular use. The present claimed system provides both an outside and an inside drip edge corner piece and a continuous vent section with non-louvered sections on the ends, allowing the continuous edge venting material to be easily installed around corners of the roof without timely modifications. The non-louvered continuous pieces can also be adaptable to roof corners without the use of the corner pieces. The present claimed venting system provides a highly advantageous system which can be quickly installed around corners of the roof edge, provides an attractive drip edge, and provides venting along the entire drip edge of a roof of an attic to be ventilated. Prior devices have failed to provide a means for installing the ventilation system around roof corners which installers can quickly and confidently install which also providing the functionality of venting the roof up to the roof corners.

SUMMARY OF THE INVENTION

It is accordingly an object of the present invention to provide a continuous roof ventilation system which provides continuous drip edge material around the roof corners while also supplying a system which can be quickly and economically installed while providing an attractive drip edge for the roof to be ventilated.

It is further an object of the present invention to provide an improvement for a continuous drip edge ventilation which allows the continuous roof edge ventilation system to be installed around inside and outside roof corners.

It is a further object of the present invention to provide an inside corner piece which continues a continuous roof drip edge around a roof's inside corner and an outside corner piece which continues a continuous roof drip edge around a roofs outside corner.

DETAILED DESCRIPTION OF THE DRAWINGS

The invention relates to an improvement of the continuous roof drip edge described in patent application Ser. No. 08/634,021, and corner pieces adaptable to be used with the vent material described in that application or a modified version of that vent material. The inventor has found that installation of the continuous vent material is difficult on corners of the roof edge, and field alterations of the continuous venting material to facilitate corners results in an unsightly inconsistent final product. Accordingly the present invention provides an improved alternative for installation of the continuous roof edge venting material on corners of a roof.

Figure 1:
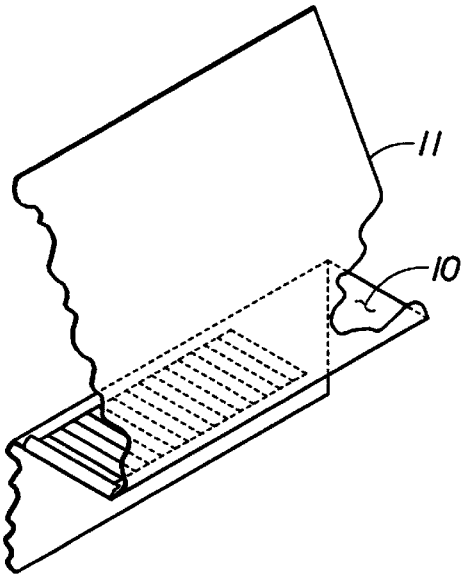
FIG. 1 is a perspective view of the continuous roof edge vent illustrating a nonlouvered end portion suitable for adapting to an inside corner on a roof edge.
Figure 2:
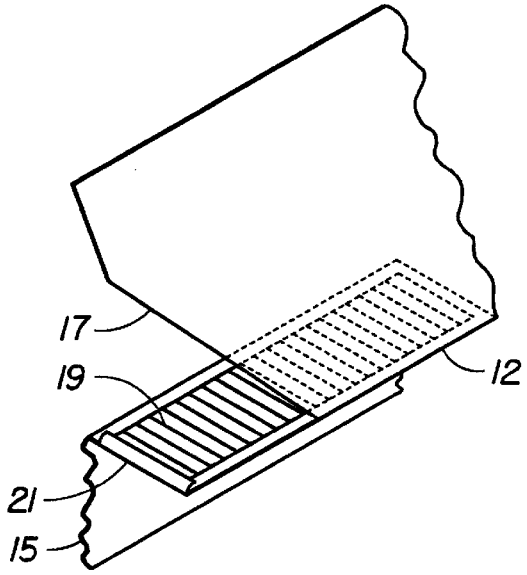
FIG. 2 is a perspective view of the continuous roof edge vent illustrating a notched section suitable for adapting to an inside corner on a roof edge.
Figure 3:
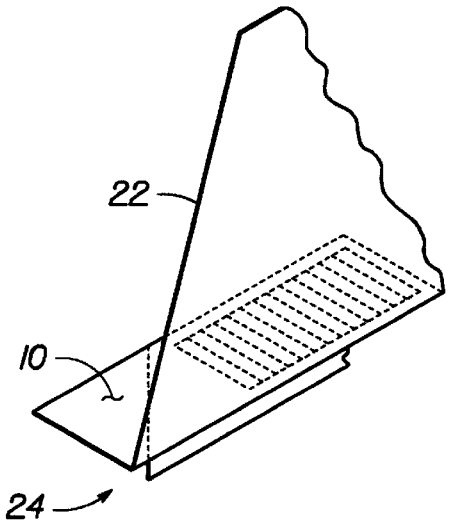
FIGS. 3 and 4 are a perspective views of both left and right hand continuous roof edges illustrating nonlouvered end portion with angled upper portions and notched lower members suitable for adapting the two pieces to an outside corner on a roof edge.
Figure 4:
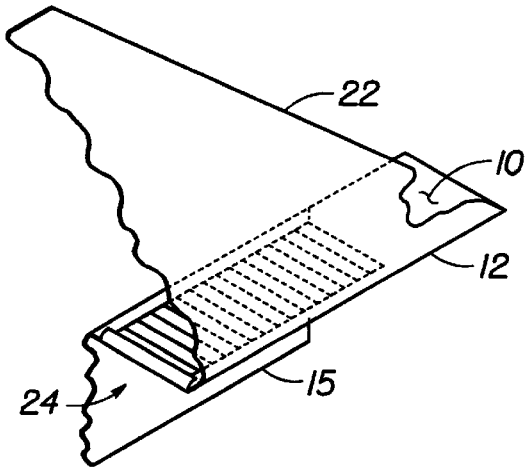
Figure 5:
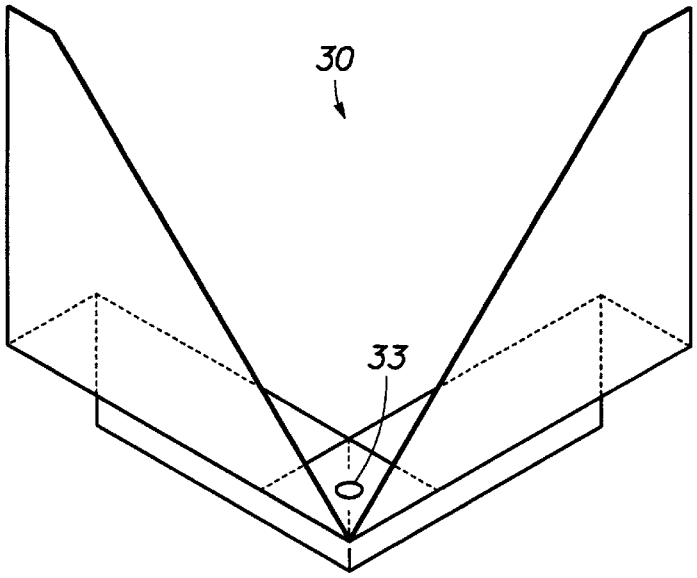
FIG. 5 is a perspective frontal view of an outside corner piece constructed of two pieces which are illustrated in FIGS. 6 and 7.
Figure 6:
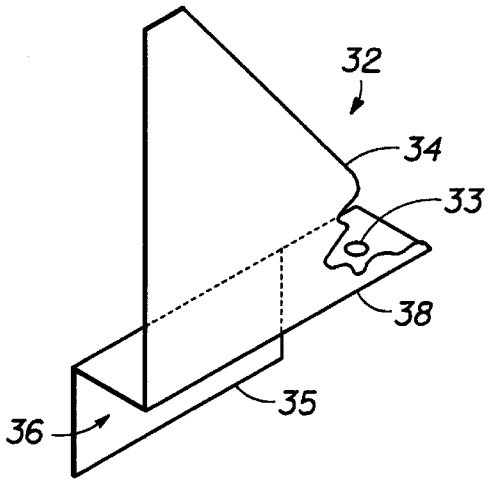
Figure 7:
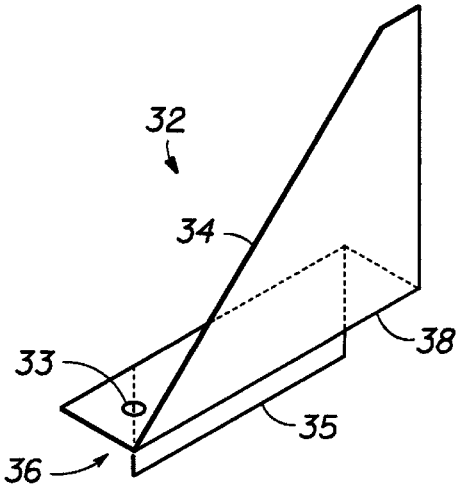

FIGS. 1, 2, 3, and 4 illustrate improvements of the continuous edge ventilation member necessary for adapting the venting material to corners without any additional new pieces. FIGS. 1 and 2 illustrate the improvements for adapting the continuous vent material for an inside corner of a roof drip edge, while FIGS. 3 and 4 illustrate the improvements for adapting the continuous vent material for an outside corner of a roof drip edge. As seen in FIG. 1 an end nonlouvered middle panel section 10 is provided, the length of the nonlouvered section should correspond approximately to the distance from the vent outside edge 12 the lower panel section 15 of the other panel as illustrate in FIG. 2. The nonlouvered middle panel section end 11 of the vent material in FIG. 1 is placed into the inside corner of the roof drip edge and abutted against the vertical wall member of the meeting roof edge. The other venting member, as illustrated in FIG. 2, has a notched angled upper panel section 17 which allows the end 21 of the venting material to be abutted against the vertical wall member of the meeting roof edge, while the louvered section 19 overlaps the nonlouvered section 10 of the other vent material.

FIGS. 3 and 4 illustrate the venting material adapted to an outside corner of a roof edge. Each of the two pieces that meet at an outside corner are equipped with a nonlouvered section 10 as described above in FIG. 1, furthermore the meeting ends have angled upper panel sections 22 which are preferably mirror images of each other. Additionally, an end section of the lower panel section 24 is removed from each of the vent material ends, the length of the lower panel section removed should correspond to the distance from the outside edge 12 and lower panel 15. The angle of the upper section should correspond to the roof incline angle. The nonlouvered section 10 of the continuous venting material may be provided from the factory or it may be adapted in the field by compressing the louvered openings back to a flat configuration.

An alternative to cutting the ends of the continuous venting material is illustrated in FIGS. 5–16, wherein separate corner pieces are illustrate for inside and outside corners.

Figure 8:
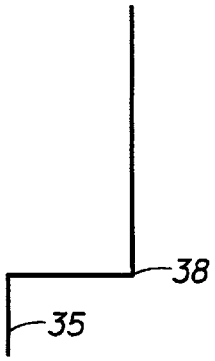
FIG. 8 is a side view of the pieces illustrated in FIGS. 6 and 7.
Figure 9:
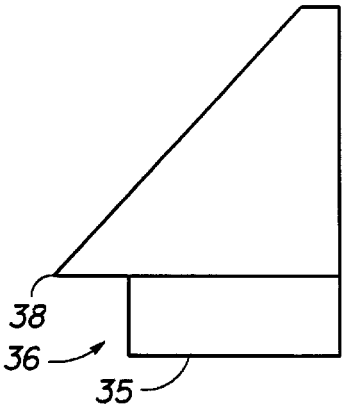
FIG. 9 is a front plain view of the piece illustrated in FIG. 6.
Figure 10:
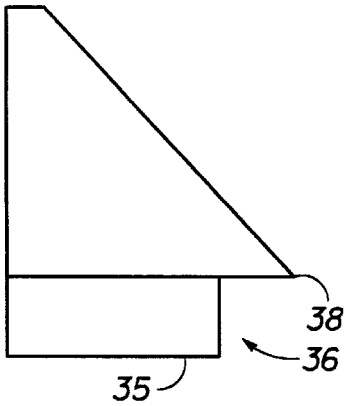
FIG. 10 is a front plain view of the piece illustrated in FIG. 7.
Figure 11:
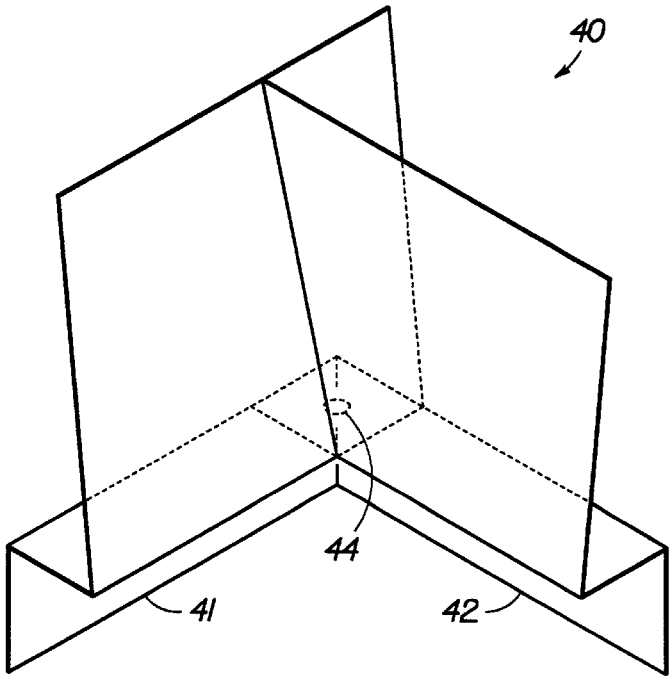
FIG. 11 is a perspective frontal view of an inside corner piece constructed of two pieces which are illustrated in FIGS. 12 and 13.
Figure 12:
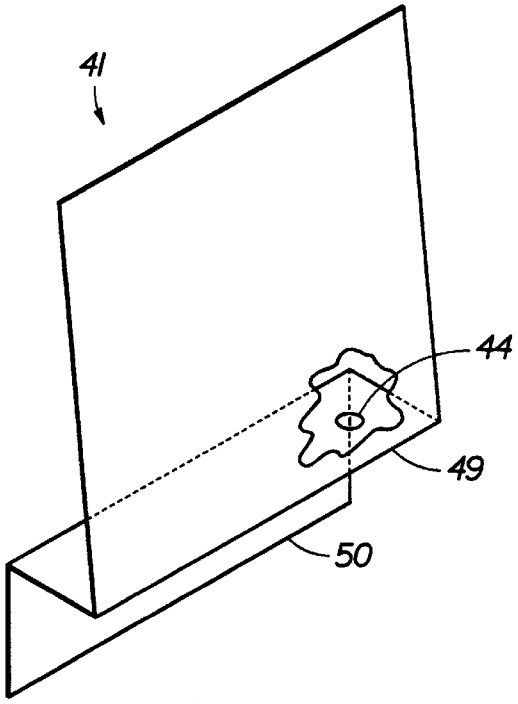
Figure 13:
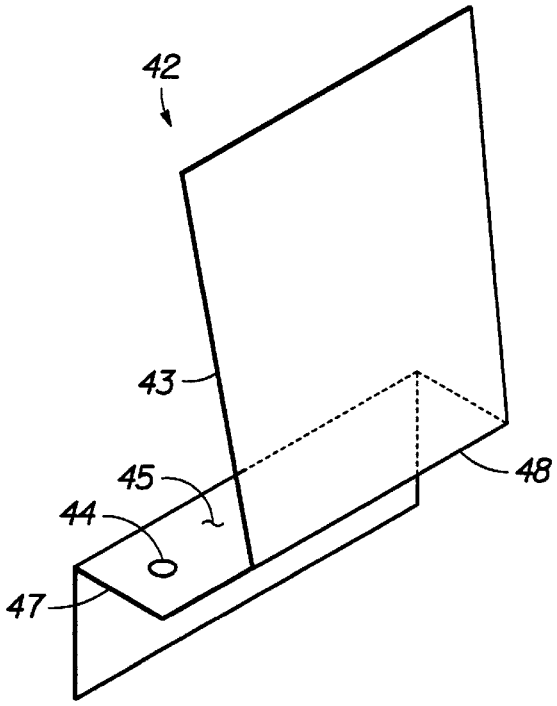

FIGS. 5–10 illustrate the outside corner piece 30 which is designed to accompany the continuous venting material. The venting material may be provided with either louvered ends or nonlouvered ends. The outside corner piece 30 is composed of two pieces 32 which are virtually mirror images of each other. The profile, as illustrated in FIG. 8, of the pieces matches the profile of the venting material so that a consistent appearance can be maintained throughout the corner of the roof edge. The pieces upper panel section is angled 34 to correspond to the roof incline angle, furthermore a section of the lower panel member 36 is removed, the length of the removed section should correspond to the length between the outer edge 38 and the lower panel member 35. The two pieces are joined at a point on the middle panel section 33 which allows the interrelation of the two pieces to form an angle in relation to each other to corresponds to the roofs outside corner angle. The venting material ends are overlapped by the corner piece providing an attractive finished corner of the drip edge.

Figure 14:
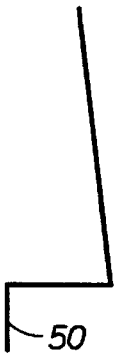
FIG. 14 is a side view of the illustrated in FIGS. 12 and 13.
Figure 15:
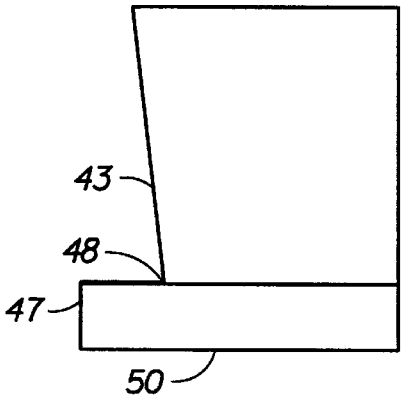
FIG. 15 is a front plain view of the piece illustrated in FIG. 12.
Figure 16:
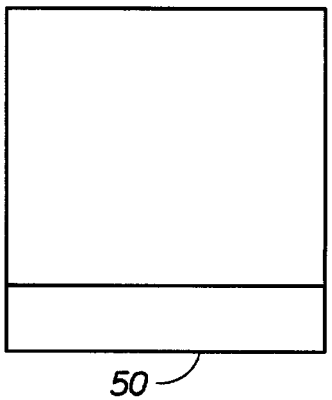
FIG. 16 is a front plain view of the piece illustrated in FIG. 13.

FIGS. 11–16 illustrate the inside corner piece which is designed to accompany the continuous venting material. The venting material may be provided with either louvered ends or nonlouvered ends. The inside corner piece 40 is composed of two separate pieces, a planar piece 41 and an angled piece 42, both pieces have a profile, as illustrated in FIG. 14, which matches the profile of the venting material. The angled piece 42 has an angled upper panel section 43 which corresponds with the roof incline angle. The angled upper panel section also allows the two pieces to be joined at a point on the middle panel section 44. When the two pieces are joined they form an angle, in relation to one another, which corresponds to the angle of the roof edge. The angled upper panel section 43 is positioned so that the middle panel section 45 is exposed allowing the two pieces to be joined at point 44. Furthermore the distance between the end of the angled piece 47 and the angle 48 should correspond to the distance between the outside edge 49 and the lower panel member 50. The vent member ends are overlapped by the inside corner piece providing an attractive finished corner piece.

I claim:

1. A continuous roof drip edge vent adaptable around corners of a roof edge wherein the continuous vent is installed upon a building having an inclined roof structure and vertical wall structures, and an opening that meets the roof structure and the vertical wall structure, the continuous vent comprises an elongated one piece planar panel including, an elongated upper panel section for disposition on the incline roof structure, a planar lower section suited for abuttable attachment to the vertical wall structure, a louvered middle panel section positioned between said upper and lower sections and further perpendicular to said lower section, a 90 degree bend connecting the lower panel section to the middle section, and an angled bend connecting the middle section to the upper section, while said louvered middle section includes a plurality of juxtaposed slit openings extending perpendicularly between said bends forming louvers between the slits, said louvers are further rotated uniformly along their longitudinal axis creating louver openings for passage of air flow, and wherein said elongated upper panel section extends at least five inches from said angled bend connecting the middle and upper sections, the improvement comprising:

a) a means for providing the continuous roof ventilation material around an outside corner of a roof to be vented, and b) a means for providing the continuous roof ventilation material around an inside corner of a roof to be vented.

2. The improvement as set forth in claim 1 wherein the means for providing the continuous roof ventilation material around an inside corner of a roof further comprises, two continuous roof drip edge venting members meeting at an inside corner of a roof, one of the continuous roof drip edge venting members provided with a short nonlouvered middle panel section while a portion of the other venting member upper panel section is cut at an angle and removed to correspond with a roof incline angle and further to provide a means to interconnect the two venting members by overlapping the louvered middle panel section of the angled venting member with the nonlouvered middle panel section of the other venting member.

3. The improvement as set forth in claim 1 wherein the means for providing the continuous roof ventilation material around an outside corner of a roof further comprises, two continuous roof drip edge venting members meeting at an outside corner of a roof, both continuous roof drip edge venting members provided with a short nonlouvered middle panel section at their ends, an angled upper panel end portion of each venting member is provided at an angle to correspond with a roof incline angle and further to provide a means to interconnect the two venting members by overlapping the nonlouvered middle panel sections of the venting members.

4. Continuous roof drip edge eave vent corner pieces adaptable to be used with continuous roof drip edge vent, the continuous vent comprises an elongated one piece planar panel including, an elongated upper panel section for disposition on the incline roof structure, a planar lower section suited for abuttable attachment to the vertical wall structure, a louvered middle panel section positioned between said upper and lower sections and further perpendicular to said lower section, a 90 degree bend connecting the lower panel section to the middle section, and an angled bend connecting the middle section to the upper section, while said louvered middle section includes a plurality of juxtaposed slit openings extending perpendicularly between said bends forming louvers between the slits, said louvers are further rotated uniformly along their longitudinal axis creating louver openings for passage of air flow, and wherein said elongated upper panel section extends at least five inches from said angled bend connecting the middle and upper sections, the corner pieces comprising;

a) an outside corner piece providing a means to adapt to a roof incline angle and providing a means to adapt two continuous venting members which meet at the outside corner, and b) an inside corner piece providing a means to adapt a roof incline angle and further providing a means to adapt two continuous venting members which meet at the inside corner.

5. The outside corner piece as set forth in claim 4 wherein the outside corner piece further comprises, two mirror image pieces, each piece having an angled upper panel adaptable for placement on a roof incline section, lower panel section suited for abutable attachment to the vertical wall structure section and a middle nonlouvered section connecting the upper and lower panels, a means for attaching the two pieces in a configuration that conforms to the roof outside corner.

6. The inside corner piece as set forth in claim 4 wherein the inside corner piece further comprises two planar pieces, one piece having a reverse angle upper panel section and the other piece having a straight upper panel section, the upper panel sections are adaptable to attachment to a roof incline section, while the reverse angled upper panel section is angled to correspond to a roof incline angle and further provides access to allow the two pieces to be secured to each other, each piece has a lower panel suited for abutable attachment to the vertical wall section and a nonlouvered middle section, and a means for securely attaching the two pieces in a configuration that conforms to the roof inside angle.

7. The corner pieces as set forth in claim 4 wherein the continuous venting material is provided with an end portion short nonlouvered middle panel section which provides a means for adapting the continuous venting member to the corner pieces.

8. The outside corner piece as set forth in claim 7 wherein the outside corner piece further comprises, two mirror image pieces, each piece having an angled upper panel adaptable for placement on a roof incline section, lower panel section suited for abutable attachment to the vertical wall structure section and a middle nonlouvered section connecting the upper and lower panels, a means for attaching the two pieces in a configuration that conforms to the roof outside corner.

9. The inside corner piece as set forth in claim 7 wherein the inside corner piece further comprises two planar pieces, one piece having a reverse angle upper panel section and the other piece having a straight upper panel section, the upper panel sections are adaptable to attachment to a roof incline section, while the reverse angled upper panel section is angled to correspond to a roof incline angle and further provides access to allow the two pieces to be secured to each other, each piece has a lower panel suited for abutable attachment to the vertical wall section and a nonlouvered middle section, and a means for securely attaching the two pieces in a configuration that conforms to the roof inside angle.

* * * * *